US005279018A

United States Patent [19]

Glenn, III

[11] Patent Number: 5,279,018

[45] Date of Patent: Jan. 18, 1994

[54] QUICK CONNECT ROTARY BEARING FOR A VACUUM CLEANER

[75] Inventor: William K. Glenn, III, Anderson, S.C.

[73] Assignee: Ryobi Motor Products Corp., Easley, S.C.

[21] Appl. No.: 819,398

[22] Filed: Jan. 10, 1992

[51] Int. Cl.[5] ..... A47L 9/22

[52] U.S. Cl. ..... 15/412; 15/351; 384/295

[58] Field of Search ..... 15/350, 351, 412, 410; 384/295

[56] References Cited

U.S. PATENT DOCUMENTS

| | | | |
|---|---|---|---|
| D. 301,648 | 6/1989 | Kieft | D32/22 |
| 2,300,266 | 10/1942 | Smellie | 15/350 X |
| 2,633,596 | 4/1953 | Turner et al. | 15/350 X |
| 2,898,621 | 8/1959 | Vance | 15/350 X |
| 2,898,622 | 8/1959 | Hurd | 15/350 X |
| 3,031,710 | 5/1962 | Huening | 15/350 X |
| 3,634,905 | 1/1972 | Boyd | 15/350 |
| 3,675,268 | 7/1972 | Nordeen | 15/350 |
| 3,763,635 | 10/1973 | Schmitz | 15/351 X |
| 4,637,092 | 1/1987 | Hayashi et al. | 15/319 |
| 4,959,885 | 10/1990 | Sovis et al. | 15/350 X |
| 4,996,737 | 3/1991 | Madru, Sr. | 15/366 |
| 5,056,175 | 10/1991 | Stein et al. | 15/49.1 |
| 5,093,956 | 3/1992 | Saunders et al. | 15/351 |

*Primary Examiner*—Chris K. Moore
*Attorney, Agent, or Firm*—Brooks & Kushman

[57] ABSTRACT

A rotary bearing is disclosed for pivotably connecting a journal to a similar cylindrical saddle formed in a chassis member. The rotary bearing is provided with an annular sleeve having inner surface sides to freely rotatably cooperate with the journal. The annular sleeve outer surface has affixed to it an arcuate flange extending radially outward and about a limited portion of the sleeve periphery. The flange includes a relatively thin web section and a thicker head portion spaced radially outward therefrom to enable the flange to interconnect with the arcuate slot formed in a semi-cylindrical saddle surface. The rotary bearing can be quickly installed and removed without the use of fasteners or installation tools and is particularly suitably adapted for use in mounting an upright vacuum motor/fan assembly to the cleaner head chassis.

10 Claims, 2 Drawing Sheets

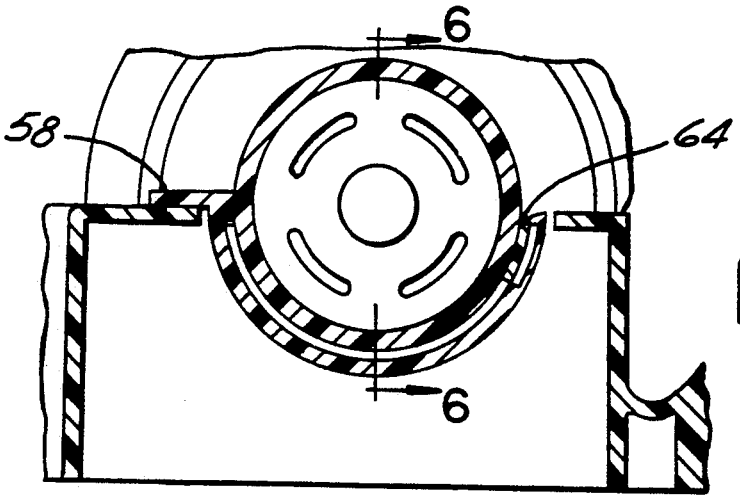
Fig-4
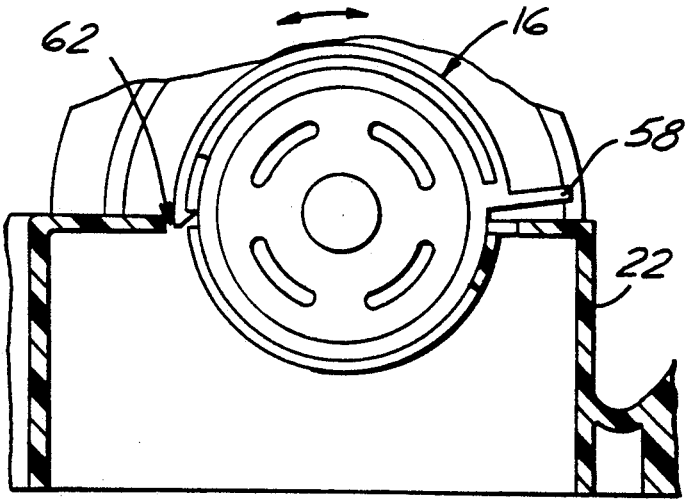
Fig-5
Fig-6
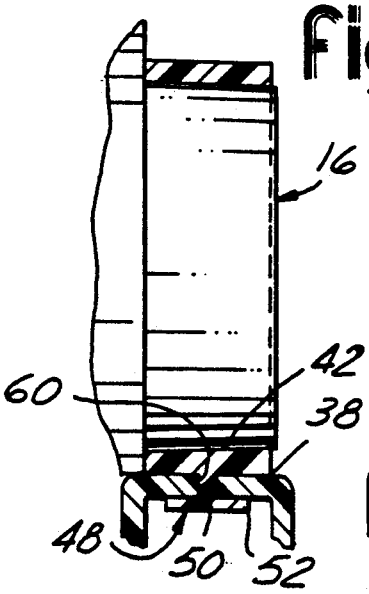
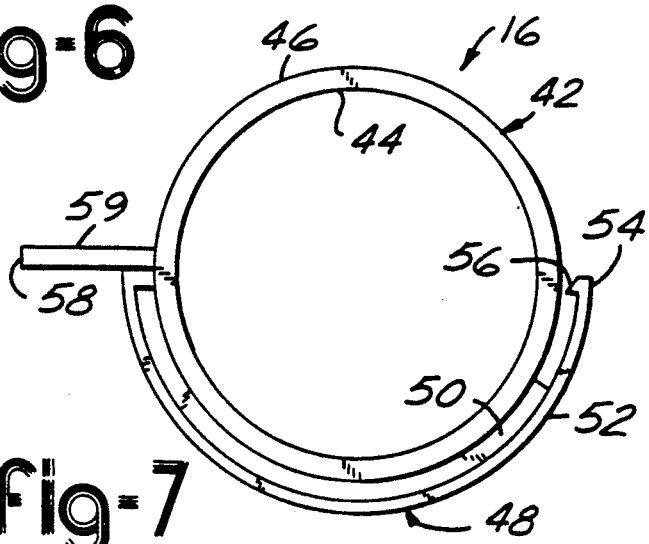
Fig-7

QUICK CONNECT ROTARY BEARING FOR A VACUUM CLEANER

TECHNICAL FIELD

This invention relates to rotary bearings, particularly those adapted for use in household vacuum cleaners.

BACKGROUND ART

Upright vacuum cleaners frequently utilize a combined motor/fan assembly which is attached to the upright handle bag portion and is pivotably mounted to and generally housed within a floor-mounted chassis. The motor/fan assembly blows dirt-ladened air directly from the fan chamber into the handle bag assembly. Since the motor/fan assembly and handle are affixed to one another, the air passageway therebetween may be rigid having smooth interior walls which do not tend to collect dirt and debris. The handle and attached motor/fan assembly typically are capable of rotating approximately 90° relative to the chassis assembly. One axial end of the motor/fan assembly typically provides an air inlet to the fan chamber while the opposite end provides a rotary output shaft for driving a rotary brush.

Typically, vacuum cleaners of the prior art design pivotably mount the motor/fan assembly to the chassis utilizing a pair of conventional journal bearings. A cylindrical journal is formed on each end of the motor/fan assembly generally coaxial with the motor/fan axis. A pair of corresponding webs having a semi-cylindrical saddle sized to cooperate with each of the journal are formed in the chassis. A pair of semi-cylindrical caps are affixed to the chassis using conventional fasteners such as screws or the like to form a cylindrical bearing surface rotatably cooperating with the journals on the motor/fan assembly. Vacuum cleaners of this general prior art design are illustrated in U.S. Pat. Nos. 4,637,092, 4,996,737, 5,056,175 and Des. 301,648.

SUMMARY OF THE INVENTION

An object of the present invention is to provide a bearing assembly for an upright vacuum cleaner which can be quickly installed without the use of tools or fasteners.

Another object of the present invention is to provide a rotary bearing for pivotably supporting a motor/fan assembly to the chassis of an upright vacuum cleaner where the rotary bearing can be made of a material dissimilar to that of the chassis in order to facilitate the use of relatively more expensive bearing materials to optimize wear and lubricity.

Another object of the present invention is to provide quick connect bearing which can be visually inspected to determine that a secure attachment has been achieved.

Accordingly, the rotary bearing of the present invention provides a secure pivotable connection for a journal of a motor fan assembly to the chassis of an upright vacuum cleaner. The bearing includes an annular sleeve having a generally cylindrical inner surface sized to freely rotate with the journal of the motor/fan assembly. The bearing sleeve has affixed to it an arcuate flange projecting outward and extending about a limited portion of the sleeve periphery. The flange is provided with a relatively thin web section adjacent the sleeve and a thicker head portion outboard thereof to enable the flange to be interlocked within an arcuate slot formed in the vacuum cleaner chassis.

The advantages of the present invention will become apparent from the drawings, the following description and the appended claims.

BRIEF DESCRIPTION OF THE DRAWINGS

FIG. 4 is cross-sectional end view taken along line 4—4 of FIG. 3;

FIG. 5 is a cross-sectional side view similar to that of FIG. 4 with the bearing assembly rotated to the release state;

FIG. 6 is a cross-sectional side elevational view taken along line 6—6 of FIG. 4; and FIG. 7 is a side elevational view of the rotary bearing.

BEST MODES FOR CARRYING OUT THE INVENTION

Figure 1:
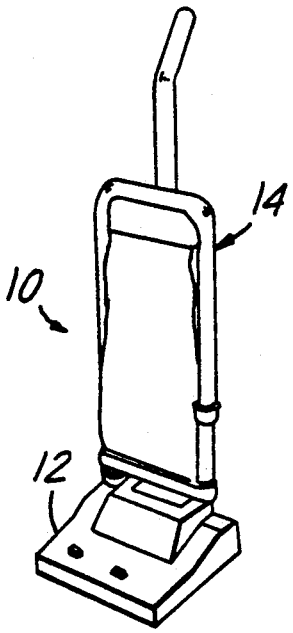
FIG. 1 is a perspective view of an upright vacuum cleaner.

FIG. 1 illustrates an upright vacuum 10 provided with a floor-mounted cleaner head assembly 12 having a handle vacuum bag assembly 14 pivotably attached thereto. The handle bag assembly is pivotable between the upright condition illustrated to a rearwardly inclined orientation typically used when the vacuum is in operation. The rotary bearing of the present invention is utilized for pivotably interconnecting the handle vacuum assembly to the chassis of the floor-mounted cleaner head.

Figure 2:
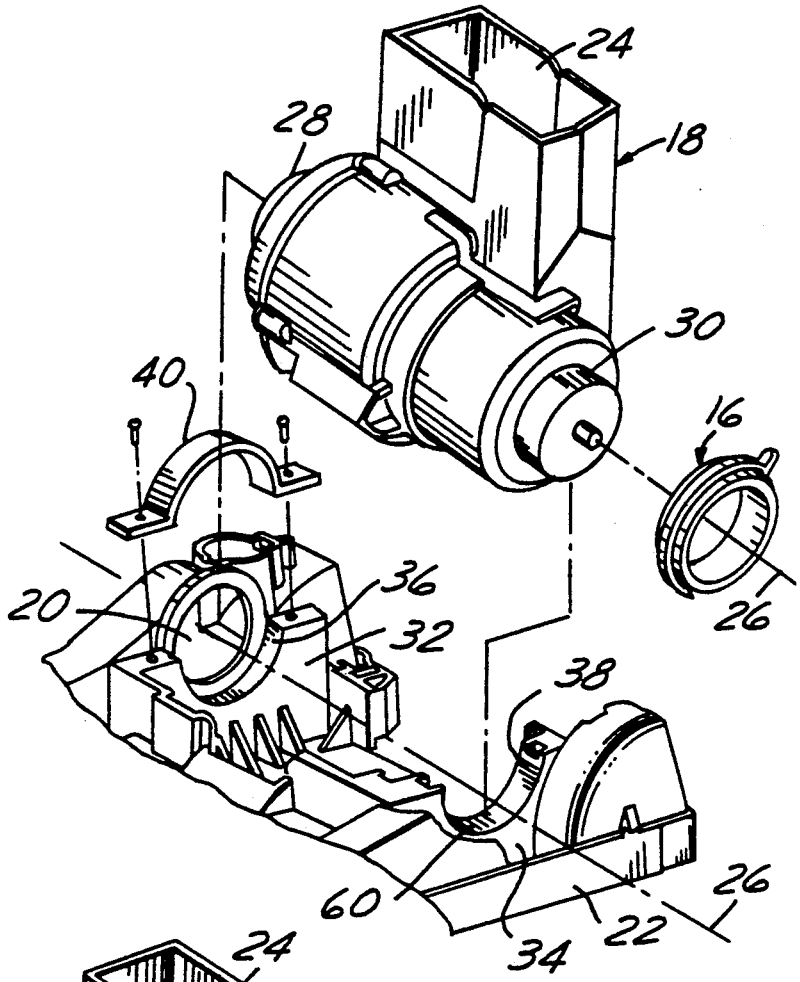
FIG. 2 is an exploded perspective view of a portion of the vacuum cleaner illustrating the present invention.

FIG. 2 illustrates an exploded partial view of the vacuum cleaner illustrating the components pertinent to the operation of rotary bearing 16. Motor/fan assembly 18 is made up of a transversely mounted electric motor which drives a fan, both of which are mounted within a rigid plastic housing. The housing defines a fan chamber having an axial air inlet in communication with vacuum chamber 20 in chassis 22 and a tangential air outlet 24 connected to the handle vacuum bag assembly. The motor/fan assembly lies along a horizontal transverse axis 26 and pivotably rotates thereabout relative to chassis 22 of the vacuum cleaner head. On opposite transverse ends of motor/fan assembly 18, a pair of journals 28 and 30 are provided. Journals 28 and 30 are preferably generally cylindrical in shape and are integrally molded into the plastic housing which forms a part of motor/fan assembly 18.

Formed in the chassis at opposite ends of the transverse axis 26 are a pair of webs 32 and 34 which define a pair of semi-cylindrical concave saddle surfaces 36 and 38 therein. In the vacuum cleaner embodiment illustrated in FIG. 2, the left side of the motor/fan assembly is pivotably connected to the chassis using a conventional journal bearing of the prior art type. Journal 28 directly bears upon saddle surface 36. Bearing cap 40 is affixed to the chassis utilizing a pair of fasteners such as conventional screws or the like and is provided with an inner cylindrical surface which a mirror image of the cylindrical surface of saddle 36. Cap 40 in combination with saddle 36 provides a cylindrical surface which completely surrounds the journal 28. Sufficient radial clearance between the cylindrical surface of cap 40 and the saddle 36 and journal 28 is provided so that the motor/fan assembly can rotate relative to the chassis. A conventional seal (not shown) is provided in order to prevent air leakage through the rotary connection.

Figure 3:
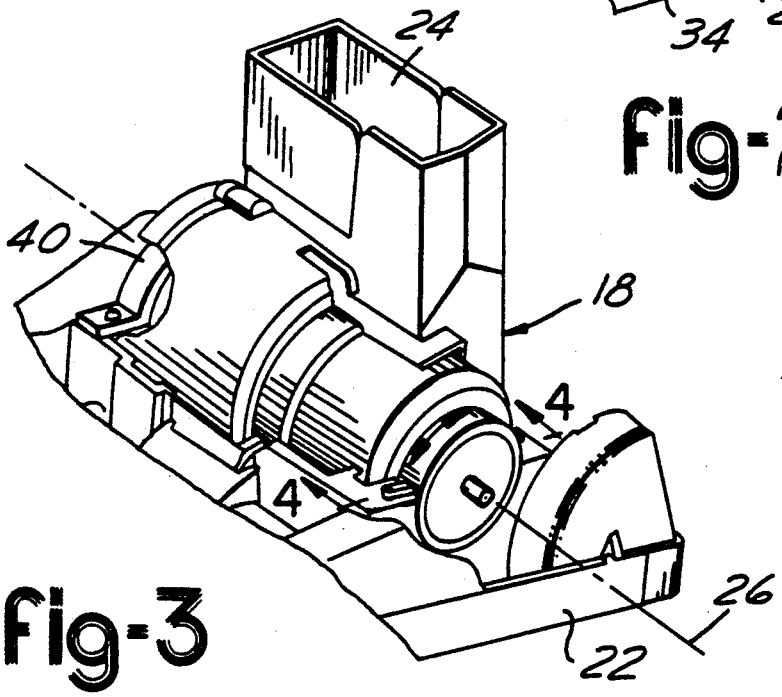
FIG. 3 is a perspective view of the components from FIG. 2 in the assembled state.

The right side of the motor/fan assembly illustrated in FIG. 2 is provided with bearings 16 of the present invention. Bearings 16 facilitates the quick connection and disconnection of the motor/fan assembly into the chassis without the use of fasteners for assembly. Bearing 16 is telescopically installed upon the journal 30 of the motor/fan assembly. With the bearing installed in place in the saddle as illustrated in FIG. 3, the bearing 16 is rotated counterclockwise approximately one-half the turn causing the bearing to engage and securely lock to the chassis providing a secure assembly as shown in FIG. 3. When assembled, the motor/fan assembly 18 is free to rotate relative to the biasing about the transverse axis 26 as indicated by the double-ended arrow. The detailed structure of the bearing 16 and the corresponding saddle 38 in chassis 22 is illustrated in FIGS. 4–7.

Bearing 16 which is illustrated in side elevational view in FIG. 7 is provided with a sleeve portion 42 having an inner cylindrical surface 44 and an outer cylindrical surface 46. The sleeve 42 is generally annular in shape having a substantially rectangular cross-section. An arcuate flange 48 projects outwardly from and extends radially about a limited portion of annular sleeve 42. The arcuate flange is made up of a thin web portion 50 and a relatively thick head portion 52. An arcuate flange 48 has a first end 54 which is cantileverly suspended thereto and is provided with a latch member 56 as illustrated in FIG. 7. Arcuate flange 48 has a second end 59 which includes an enlarged stop 58 which extends radially outward from the flange. Preferably, flange 48 is of a T-shaped cross-section as shown in FIG. 6.

Saddle 38 in chassis 22 is provided with a circumferential slot illustrated in FIGS. 2 and 6 having a width which is sized to receive the web 50 of flange 48 and is sufficiently narrow to prevent flange head 52 from passing therethrough. The material of forming saddle 38 has a thickness slightly less than the radial length of the web 50 to enable head 5 to be positioned behind the material forming saddle 38 as illustrated in the FIG. 6 cross-sectional view.

Flange 48 of rotary bearing 16 and a corresponding slot 60 in saddle 38 form a quick release bayonet-type coupling. Slot 60 and the flange 48 provide means for removably connecting and disconnecting the rotary bearing to the vacuum cleaner chassis when rotated less than 180° relative to one another. While a T-shaped flange and a simple arcuate slot are utilized in the preferred embodiment, it should be appreciated that other bayonet-type connections having an L-shaped cross-section or a plurality of circumferentially spaced apart flange members could provide comparable function. The rotary bearing is rotatable between a detach state illustrated in FIG. 5 and an interlock state as illustrated in FIG. 4 simply by rotating the bearing assembly relative to the chassis. In the embodiment of the invention illustrated, when rotary bearing 16 is in the disengaged condition as shown in FIG. 5, the bearing can either be slid axially off of journal 28 or the entire motor/fan assembly and bearing can be lifted off of the saddle.

As illustrated in FIGS. 2 and 5, slot 60 is provided with an enlarged opening 62 at one end to facilitate the insertion of flange head 52. As bearing 16 is rotated counterclockwise from the position shown in FIG. 5, the flange head passes through opening 62 and the web 50 rotates within slot 60 until stop 58 engages chassis 22 preventing further relative rotation. When the bearing is rotated to the locked state as illustrated in FIG. 4, the latch 56 formed on the first end of flange 54 catches upon shoulder 64 preventing the bearing from being inadvertently removed. When it is desired to remove bearing assembly 16 from chassis 22, latch 56 is elastically biased outward using one's thumbnail or a screwdriver enabling the bearing 16 to be rotated clockwise from the locked stage shown in FIG. 4 to the unlocked stage shown in FIG. 5.

Utilizing a quick connecting bearing structure of the present invention, it is possible to form a bearing 16 of a material dissimilar to that of chassis 22, while chassis 22 will typically form the relatively low cost ejection moldable plastic material having good strength characteristics. The bearing of the present invention can be formed of a dissimilar material having wear and lubricity characteristics optimized for the particular application. Bearing 16 can be formed of ABS, nylon or any one of a number of readily available injection moldable plastic materials in order to facilitate the fabrication of a high quality, low cost bearing.

It should be appreciated of course that while the preferred embodiment is described with reference to an upright vacuum cleaner, the rotary bearing of the present design can be utilized in conjunction with other devices. While the best mode for carrying out the invention has been described in detail, those familiar with the art to which this invention relates will recognize various alternative designs and embodiments for practicing the invention as defined by the following claims.

What is claimed is:

1. A rotary bearing for pivotably connecting a journal of a motor/fan assembly to the chassis of an upright vacuum cleaner, the rotary bearing comprising:

an annular sleeve having a generally cylindrical inner surface sized to freely rotatably cooperate with a journal on a vacuum cleaner motor/fan assembly, and an outer surface radially spaced therefrom; and an arcuate flange affixed to the annular sleeve outer surface and extending radially outward about a limited portion of the sleeve periphery, said flange having a thin web portion affixed to the sleeve outer surface and a head portion affixed to and oriented radially outward of the web and having a sufficiently greater thickness to enable the flange to be releasably interlocked within an arcuate slot formed in a chassis of an upright vacuum cleaner.

2. The invention of claim 1 wherein said arcuate flange is generally T-shaped in cross-section.

3. The invention of claim 1 wherein said flange extends approximately 180° about the annular sleeve periphery.

4. The invention of claim 1 wherein one end of said arcuate flange is provided with an enlarged stop to limit the relative rotation of the rotary bearing and the chassis.

5. The invention of claim 4 wherein the end of the arcuate flange opposite the stop further comprises latch means for releasably latching the rotary bearing to the chassis hindering relative rotation therebetween.

6. A rotary bearing and chassis assembly pivotably cooperating with a relatively rotatable journal having a central axis, the assembly comprising:

a rotary bearing having an annular sleeve provided with a generally cylindrical inner surface sized to freely rotatably cooperate with a journal and an outer surface having an arcuate flange of a generally T-shaped cross-section extending radially outward and extending about a limited portion of the outer surface periphery; and a chassis member having a semi-cylindrical saddle formed therein generally coaxially aligned with the axis of the journal to be pivotably mounted thereto, said saddle provided with means for releasably connecting the arcuate flange of the rotary bearing to the chassis when the rotary bearing and the chassis are rotated less than 180° relative to one another about the journal axis.

7. The invention of claim 6 wherein said arcuate flange is generally T-shaped in cross-section.

8. The invention of claim 6 wherein said flange extends approximately 180° about the annular sleeve periphery.

9. The invention of claim 6 wherein one end of said arcuate flange is provided with an enlarged stop to limit the relative rotation of the rotary bearing and the chassis.

10. The invention of claim 9 wherein the end of the arcuate flange opposite the stop further comprises latch means for releasably latching the rotary bearing to the chassis hindering relative rotation therebetween.

* * * * *